US011774091B2

(12) United States Patent
Hur et al.

(10) Patent No.: US 11,774,091 B2
(45) Date of Patent: Oct. 3, 2023

(54) BURNER ASSEMBLY

(71) Applicant: Kyungdong Navien Co., LTD, Gyeonggi-do (KR)

(72) Inventors: Jeon Hur, Seoul (KR); Hwa Yong Cha, Seoul (KR)

(73) Assignee: Kyungdong Navien Co., LTD, Gyeonggi-do (KR)

( * ) Notice: Subject to any disclaimer, the term of this patent is extended or adjusted under 35 U.S.C. 154(b) by 337 days.

(21) Appl. No.: 16/952,090

(22) Filed: Nov. 19, 2020

(65) Prior Publication Data

US 2021/0148566 A1 May 20, 2021

(30) Foreign Application Priority Data

Nov. 19, 2019 (KR) ..... 10-2019-0148199

(51) Int. Cl.
*F23D 14/46* (2006.01)
*F23D 14/04* (2006.01)
*F24H 1/18* (2022.01)

(52) U.S. Cl.
CPC ..... *F23D 14/46* (2013.01); *F23D 14/04* (2013.01); *F24H 1/186* (2013.01)

(58) Field of Classification Search
CPC ..... F23D 14/08; F23D 14/586; F23D 14/46; F23D 2209/20; F23D 14/045; F23D 14/105; F23D 23/00; F23D 14/02; F23C 5/00; F23C 5/08
USPC ..... 431/278
See application file for complete search history.

(56) References Cited

U.S. PATENT DOCUMENTS

2014/0000534 A1* 1/2014 Naitoh ..... F23D 14/045 431/12
2015/0253035 A1* 9/2015 Naitoh ..... F23D 14/586 122/18.4
2016/0377282 A1* 12/2016 Sugioka ..... F23D 14/70 431/353
2017/0205067 A1* 7/2017 Akiyama ..... F23D 14/22
2018/0058719 A1* 3/2018 Se ..... F24H 9/02
(Continued)

FOREIGN PATENT DOCUMENTS

AT 398341 B * 9/1994 ..... F23D 14/045
CN 102635863 A 8/2012
(Continued)

OTHER PUBLICATIONS

1st Office Action for corresponding Korean Patent Application No. 10-2019-0148199, dated Jul. 19, 2022, 7 pages.
(Continued)

*Primary Examiner* — Jorge A Pereiro
(74) *Attorney, Agent, or Firm* — McDonald Hopkins LLC

(57) ABSTRACT

A burner assembly includes a plurality of burner units including, on front sides thereof, fuel inlets through which fuel is introduced into the plurality of burner units, in which the plurality of burner units cause a combustion reaction using the introduced fuel, a case to which the plurality of burner units are coupled with a predetermined separation distance therebetween, and a flow passage guide that is coupled to a front side of the case and that includes a plurality of fuel openings corresponding to the fuel inlets of the plurality of burner units, and the flow passage guide is implemented as separate from the case.

14 Claims, 17 Drawing Sheets

(56) References Cited

U.S. PATENT DOCUMENTS

| | | | | |
|---|---|---|---|---|
| 2018/0135888 | A1* | 5/2018 | Naitoh | F24H 9/14 |
| 2020/0063970 | A1* | 2/2020 | Toyama | F24C 3/14 |

FOREIGN PATENT DOCUMENTS

| | | | | |
|---|---|---|---|---|
| JP | 2002-276908 | A | 9/2002 | |
| JP | 2018-185068 | A | 11/2018 | |
| KR | 20-1996-0015046 | U | 5/1996 | |
| WO | WO-2018094752 | A1 * | 5/2018 | F23D 14/04 |

OTHER PUBLICATIONS

Korean Patent Office, Notice of Preliminary Rejection for corresponding Application No. 10-2019-0148199, report dated May 25, 2023, 7 pages, Korea.

* cited by examiner

BURNER ASSEMBLY

CROSS-REFERENCE TO RELATED APPLICATION

This application claims the benefit of priority to Korean Patent Application No. 10-2019-0148199, filed in the Korean Intellectual Property Office on Nov. 19, 2019, the entire contents of which are incorporated herein by reference.

TECHNICAL FIELD

The present disclosure relates to a burner assembly of a water heating device.

BACKGROUND

A water heating device is a device that transfers heat generated by a combustion reaction to water to heat the water and uses the heated water for heating or the supply of hot water. A process of introducing water, heating the introduced water, and releasing the heated water is performed through the water heating device.

The combustion reaction may be performed in a burner unit. The burner unit requires fuel so as to cause the combustion reaction. The fuel, while passing through the burner unit, may have a state suitable to form flames and may be ignited, and flames may be released through flame-holes of the burner unit during the combustion reaction.

To allow the fuel to be injected in a condition suitable to cause the combustion reaction, the burner unit may have the flame-holes having a thin slot shape and may be formed in a predetermined size. To heat an appropriate amount of water, a plurality of burner units may produce an appropriate amount of heat.

As the burner units become closer to each other, generated heat may be concentrated on one area. In a case where the burner units are brought into contact with each other, flames generated from the burner units may merge to produce excessively strong heat and may thus weaken the durability of a component (e.g., a heat exchanger) included in the water heating device. In contrast, in a case where the burner units are located excessively far away from each other, the burner units may not produce heat sufficient to heat water.

SUMMARY

The present disclosure has been made to solve the above-mentioned problems occurring in the prior art while advantages achieved by the prior art are maintained intact.

An aspect of the present disclosure provides a burner assembly having burner units disposed at minimized intervals.

The technical problems to be solved by the present disclosure are not limited to the aforementioned problems, and any other technical problems not mentioned herein will be clearly understood from the following description by those skilled in the art to which the present disclosure pertains.

According to an aspect of the present disclosure, a burner assembly includes a plurality of burner units including, on front sides thereof, fuel inlets through which fuel is introduced into the plurality of burner units, in which the plurality of burner units cause a combustion reaction using the introduced fuel, a case to which the plurality of burner units are coupled with a predetermined separation distance therebetween, and a flow passage guide that is coupled to a front side of the case and that includes a plurality of fuel openings corresponding to the fuel inlets of the plurality of burner units, and the flow passage guide is implemented as separate from the case.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
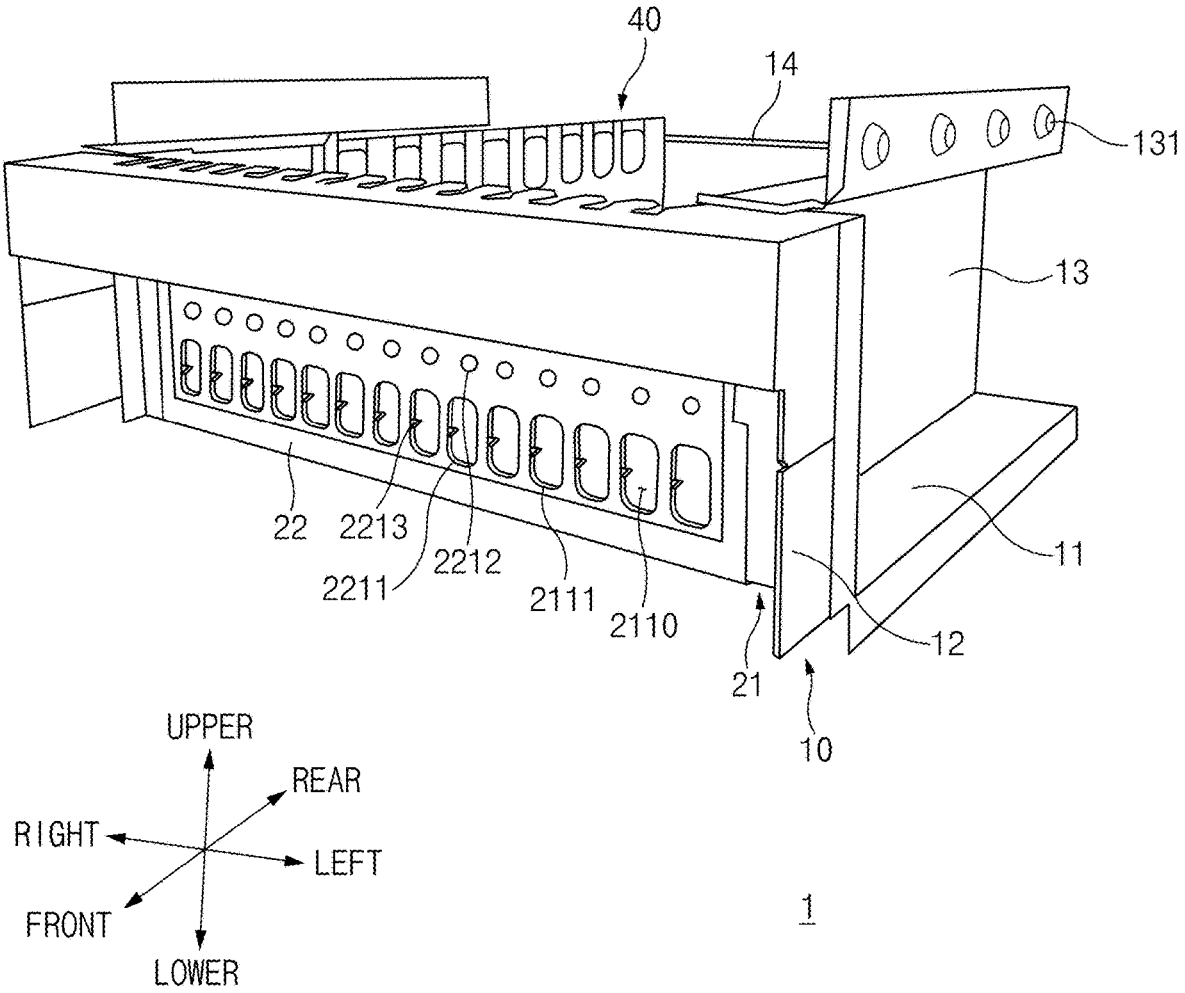
FIG. 1 is a perspective view of a burner assembly according to an embodiment of the present disclosure, where only one burner unit is assembled in the burner assembly.

Hereinafter, some embodiments of the present disclosure will be described in detail with reference to the exemplary drawings. In adding the reference numerals to the components of each drawing, it should be noted that the identical or equivalent component is designated by the identical numeral even when they are displayed on other drawings. Further, in describing the embodiment of the present disclosure, a detailed description of well-known features or functions will be ruled out in order not to unnecessarily obscure the gist of the present disclosure.

In describing the components of the embodiment according to the present disclosure, terms such as first, second, "A", "B", (a), (b), and the like may be used. These terms are merely intended to distinguish one component from another component, and the terms do not limit the nature, sequence or order of the components. When a component is described as "connected", "coupled", or "linked" to another component, this may mean the components are not only directly "connected", "coupled", or "linked" but also are indirectly "connected", "coupled", or "linked" via a third component.

Figure 2:
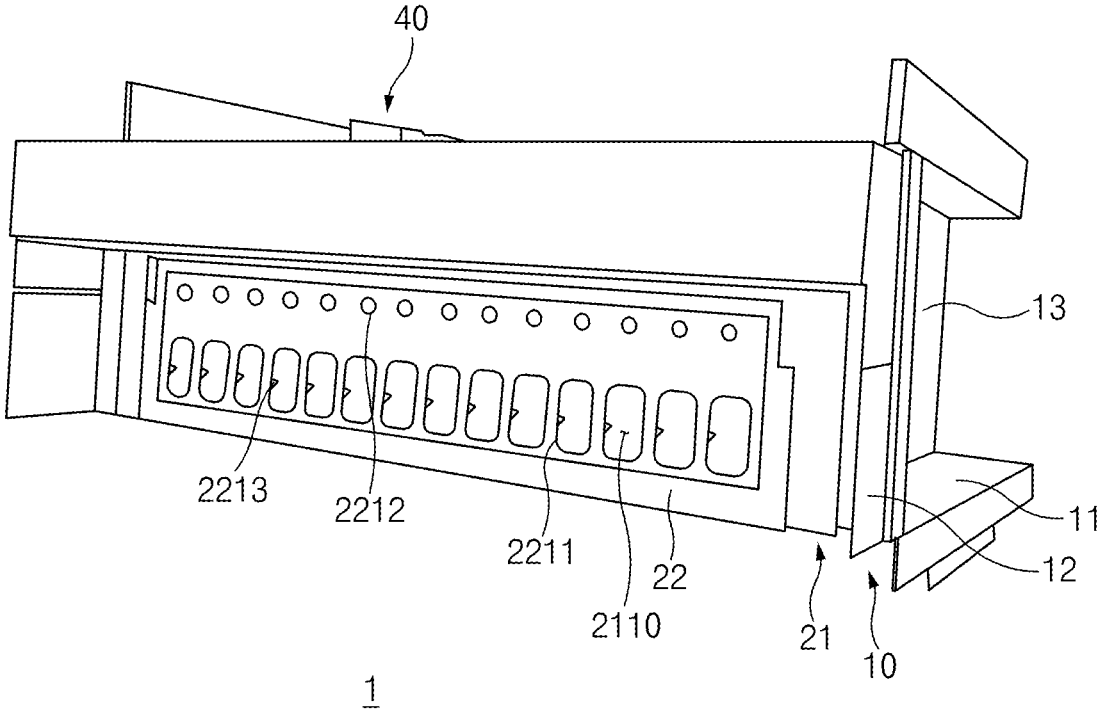
FIG. 2 is a perspective view of the burner assembly of FIG. 1 as viewed at a different angle from that in FIG. 1.
Figure 3:
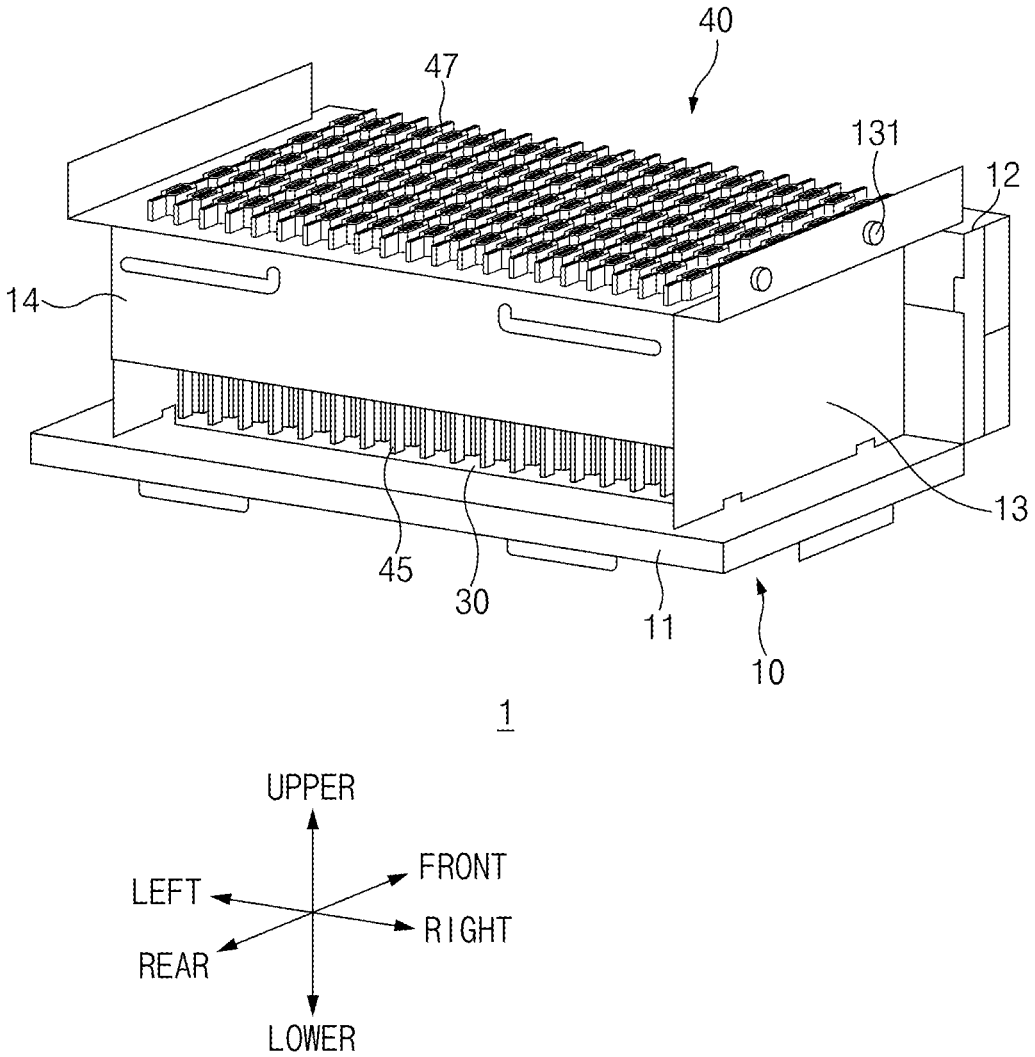
FIG. 3 is a perspective view of the burner assembly according to an embodiment of the present disclosure.

FIG. 1 is a perspective view of a burner assembly 1 according to an embodiment of the present disclosure, where only one burner unit 40 is assembled in the burner assembly 1. FIG. 2 is a perspective view of the burner assembly 1 of FIG. 1 as viewed at a different angle from that in FIG. 1. FIG. 3 is a perspective view of the burner assembly 1 according to an embodiment of the present disclosure.

Referring to FIGS. 1 to 3, the burner assembly 1 according to an embodiment of the present disclosure may include the burner unit 40, a case 10, and a flow passage guide 20. FRONT, REAR, UPPER, LOWER, LEFT, and RIGHT illustrated and described in the drawings and the specification are used for ease of understanding and represent relative directions. FRONT, REAR, UPPER, LOWER, LEFT, and RIGHT can be appropriately changed as needed.

Burner Unit 40

Figure 4:
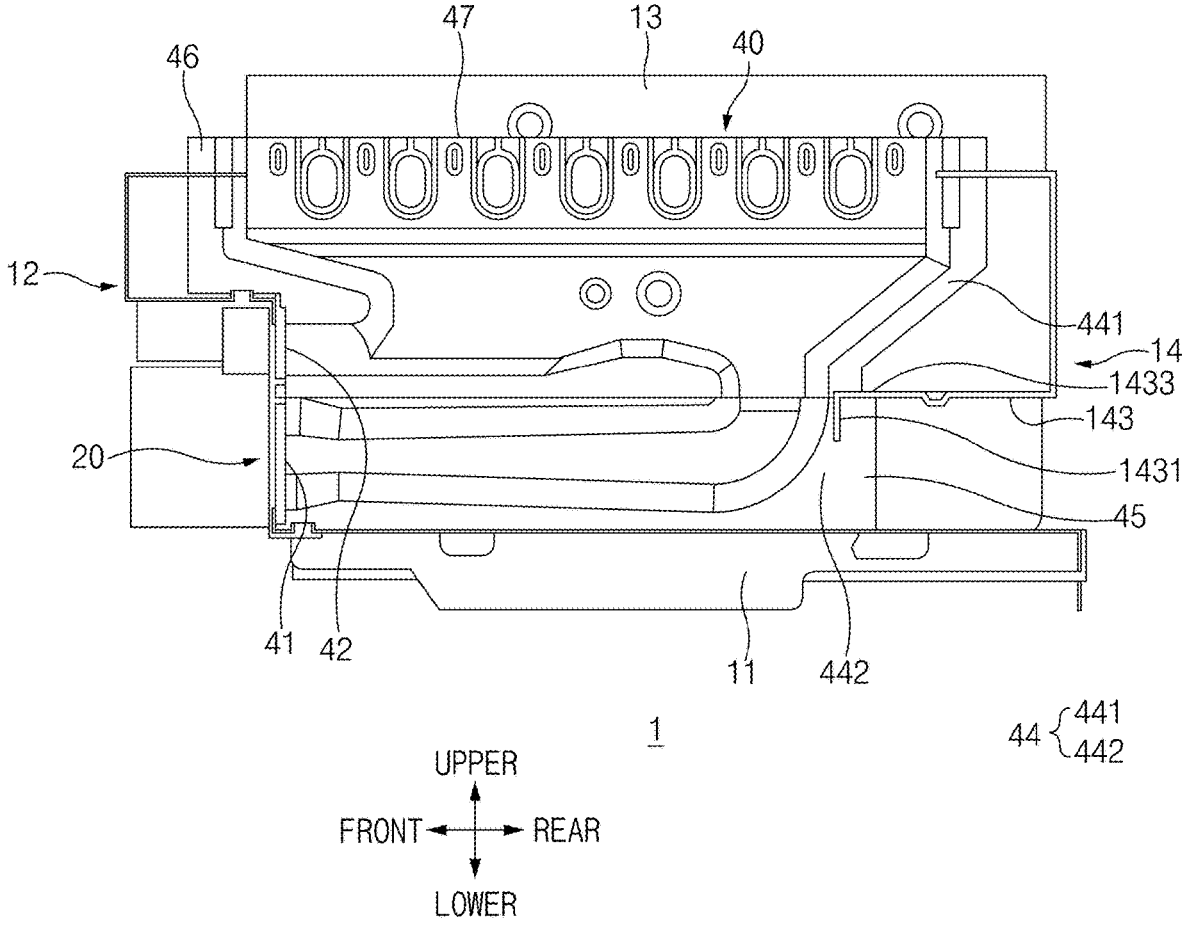
FIG. 4 is a view illustrating a vertical section of a case of the burner assembly and a side surface of the burner unit assembled in the case according to an embodiment of the present disclosure.
Figure 5:
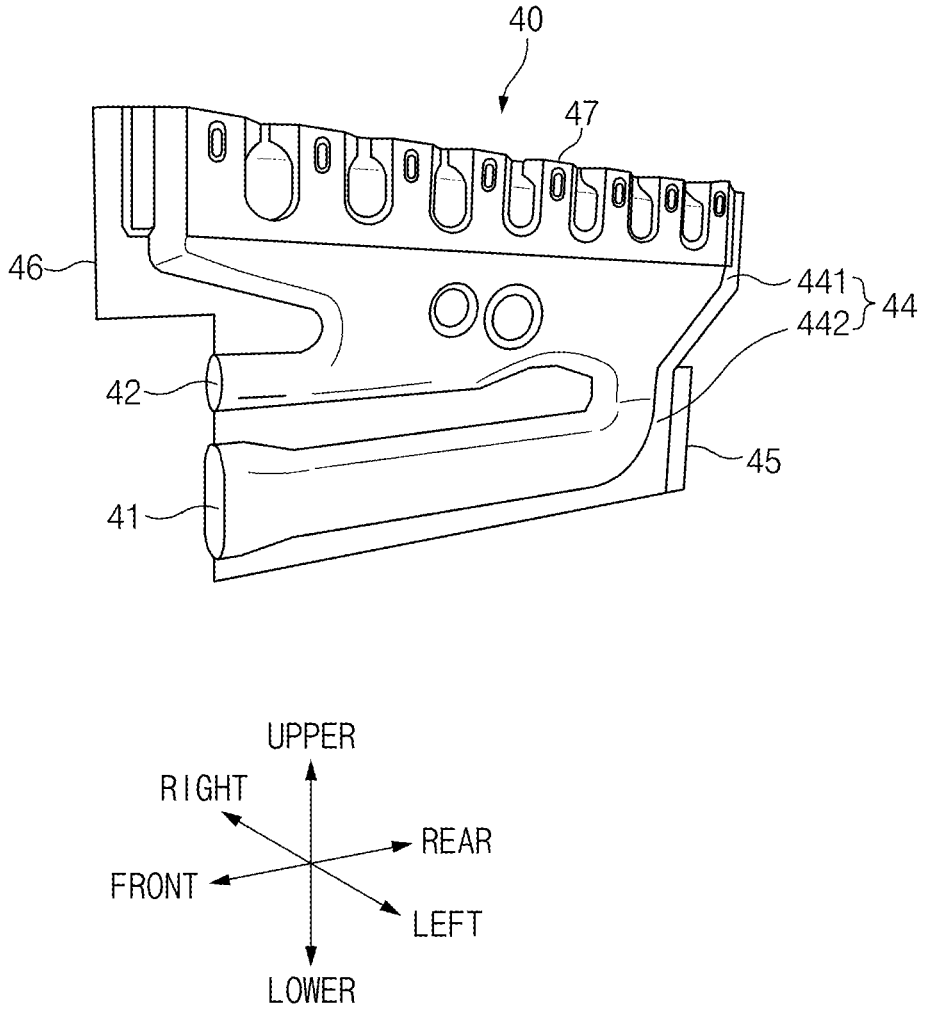
FIG. 5 is a perspective view of the burner unit according to an embodiment of the present disclosure.

FIG. 4 is a view illustrating a vertical section of the case 10 of the burner assembly 1 and a side surface of the burner unit 40 assembled in the case 10 according to an embodiment of the present disclosure. FIG. 5 is a perspective view of the burner unit 40 according to an embodiment of the present disclosure.

The burner unit 40 will be described below with additional reference to FIGS. 4 and 5. The burner unit 40 is a component that causes a combustion reaction using fuel. A plurality of burner units 40 may be provided. Although FIGS. 1 and 2 illustrate an example that only one burner unit 40 is coupled to the case 10, the plurality of burner units 40 may be coupled to the case 10 as illustrated in the following drawings.

The fuel for the combustion reaction may be introduced in a gaseous form into each of the burner units 40. At this time, air may be introduced into the burner unit 40 together with the fuel and may be mixed with the fuel to cause the combustion reaction. To this end, the burner unit 40 may include, on a front side thereof, a first fuel inlet 41 through which the fuel is introduced into the burner unit 40. The burner unit 40 may further include a second fuel inlet 42 in a different area on the front side thereof. In addition to the fuel, air may be additionally introduced through the fuel inlets. The ratio between the air and the fuel introduced through the first fuel inlet 41 may differ from the ratio between the air and the fuel introduced through the second fuel inlet 42.

The introduced fuel may be mixed with the air introduced together with the fuel in the burner unit 40 and may have a state suitable to cause a combustion reaction, and as the combustion reaction is performed, flames may be released through flame-holes 47 located at the top of the burner unit 40.

The burner unit 40 may be formed by pressing a plurality of burner plates. The burner plates may preferably be plates made of a metallic material that can resist heat and can be formed by pressing. A space in which the fuel and the air are introduced to cause a combustion reaction may be formed inside the burner unit 40, by pressing at least parts of the peripheries of the plurality of burner plates.

The burner unit 40 may include a rear insert portion 44 and a protruding portion 45. The rear insert portion 44 and the protruding portion 45 may be formed in the portion where the burner plates are pressed and may be formed to be thinner than the portion that forms the space in which the fuel and the air flow. The rear insert portion 44 is a portion formed on a rear side of the burner unit 40 so as to be fixedly inserted into a slot 1432 that will be described below. The rear insert portion 44 may be formed over the entire rear side of the burner unit 40. The protruding portion 45 is a portion protruding rearward from part of the rear insert portion 44. The protruding portion 45 may be formed to be supported by being sandwiched between a rear bracket 143 and a lower plate 11 that will be described below.

The protruding portion 45 may have a shape protruding rearward from a lower rear insert portion 442, which is a portion including the lowermost end of the rear insert portion 44, so as to be seated on the lower plate 11. An upper rear insert portion 441 may be located above the lower rear insert portion 442. An upper end of the protruding portion 45 may be pressed downward by a lower surface of the rear bracket 143, and a lower end of the protruding portion 45 may be pressed upward by an upper surface of the lower plate 11.

In addition, the burner unit 40 may include a front insert portion 46 formed on part of the front side thereof. The front insert portion 46 may also be fixedly inserted into the case 10. Accordingly, the front and rear of the burner unit 40 may be inserted into the case 10, and the position of the burner unit 40 relative to the case 10 may be fixed.

Actions of the rear insert portion 44, the protruding portion 45, the rear bracket 143, and an auxiliary bracket 30 will be described in detail in descriptions of FIGS. 14 to 17.

Case 10

Figure 6:
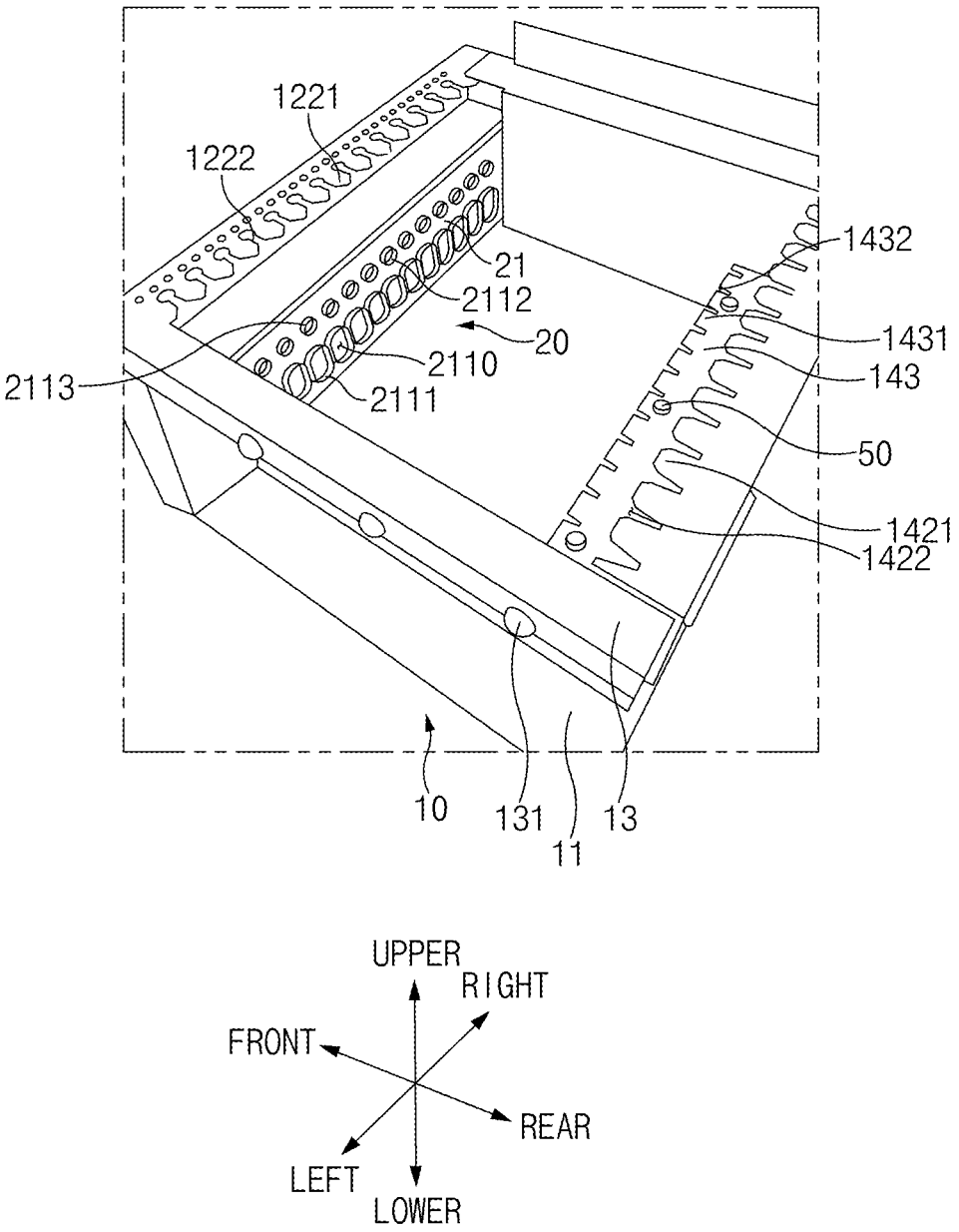
FIG. 6 is a perspective view of the case according to an embodiment of the present disclosure.

FIG. 6 is a perspective view of the case 10 according to an embodiment of the present disclosure.

The case 10 may be a component serving as a frame of the burner assembly 1, and the plurality of burner units 40 may be coupled to the case 10 with a predetermined separation distance therebetween. The case 10 may be formed by cutting and bending a case plate. The case plate may be a plate made of a material having a predetermined stiffness or more to protect the burner units 40 from external shocks and maintain a uniform interval between the burner units 40.

The case 10 may be formed in a substantially rectangular parallelepiped shape. The case 10 may include the lower plate 11 located at the bottom, a front plate 12 located at the front, a rear plate 14 located at the rear, the rear bracket 143, and two side plates 13 connecting the front plate 12 and the rear plate 14.

The burner units 40 may be seated on the lower plate 11. The front plate 12, the rear plate 14, and the side plates 13 may be seated on the lower plate 11 to form a space in which the burner units 40 are received.

The front plate 12 and the rear plate 14 may each form an opening together with the lower plate 11. The opening may be defined by the front plate 12 and an inside surface of the lower plate 11 or the rear plate 14 and the inside surface of the lower plate 11.

The front plate 12 may include front insertion recesses 1222 into which the front insert portions of the burner units 40 are inserted, and the rear plate 14 may include rear insertion recesses 1422 into which the rear insert portions 44 of the burner units 40 are inserted. The front insertion recesses 1222 may be formed between a plurality of front protrusions 1221 further protruding rearward from the front plate 12 beyond the other portion of the front plate 12. The rear insertion recesses 1422 may be formed between a plurality of rear protrusions 1421 further protruding forward from the rear plate 14 beyond the other portion of the rear plate 14. The front insertion recesses 1222 may be disposed on an upper side of the front plate 12, and the rear insertion recesses 1422 may be disposed on an upper side of the rear plate 14.

The front plate 12 and the lower plate 11 may be integrally formed with each other. However, the front plate 12 and the lower plate 11 may be formed as separate objects and may be coupled together to form the case 10.

Spacers 131 protruding outward may be disposed on the side plates 13 to maintain a predetermined interval between the side plates 13 and a housing that forms a water heating device outside the case 10.

The rear bracket 143 may be a part that protrudes forward from the rear plate 14 and that is spaced apart upward from the lower plate 11. The rear bracket 143 may include a plurality of slots 1432 between rear bracket protrusions 1431 protruding forward. The rear insert portions 44 and the protruding portions 45 of the burner units 40 may be fixedly inserted into the slots 1432.

Figure 7:
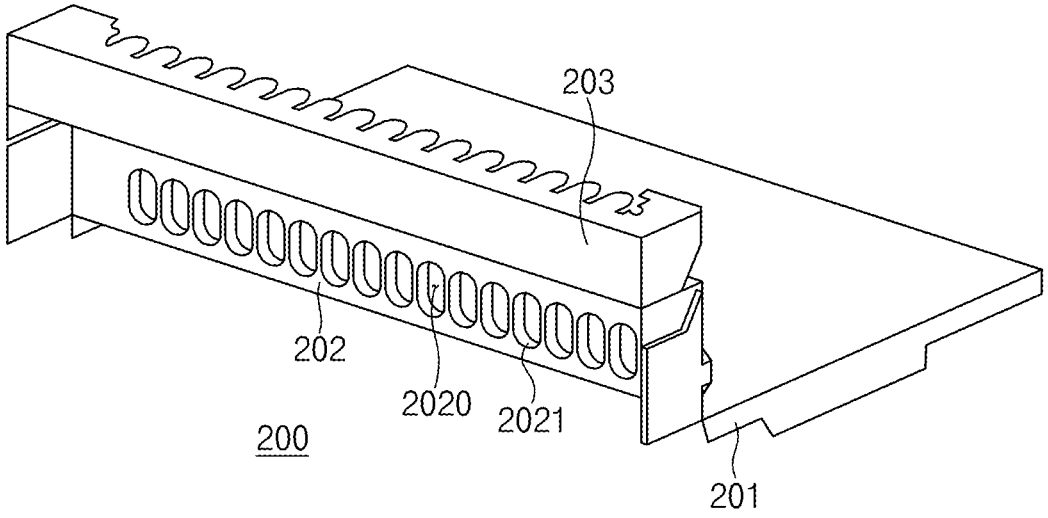
FIG. 7 is a perspective view of a portion of an exemplary case.
Figure 8:
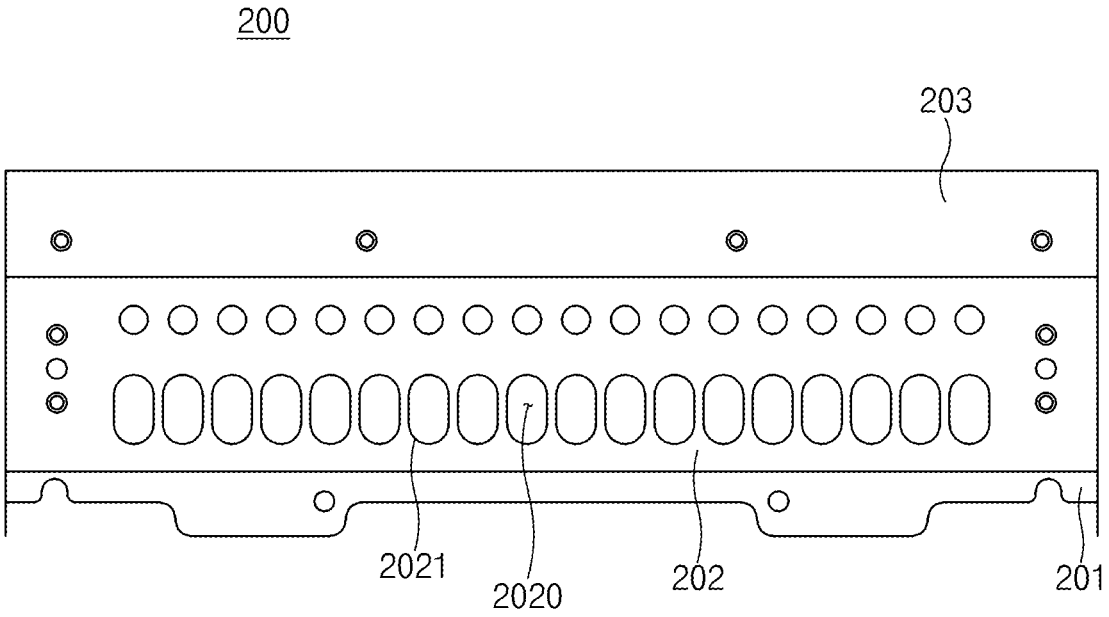
FIG. 8 is a front view of the portion of the exemplary case.

FIG. 7 is a perspective view of a portion 200 of an exemplary case. FIG. 8 is a front view of the portion 200 of the exemplary case.

Referring to the shape of the portion 200 of the exemplary case, a portion 203 corresponding to the front plate, a portion 201 corresponding to the lower plate, and a portion 202 corresponding to the flow passage guide to be described below may be integrated with one another. In the case where the portion 200 of the case is formed in this way, the case and the portion corresponding to the flow passage guide are formed by using the same plate, and due to the nature of a case plate that has to maintain a predetermined stiffness or more, a higher level of plate than a plate suitable to be used as the flow passage guide 20 is more likely to be used. In this case, intervals between fuel openings 2020 have to be formed to be wide, as compared with when a plate having less than the predetermined stiffness is used.

Flow Passage Guide 20

Figure 9:
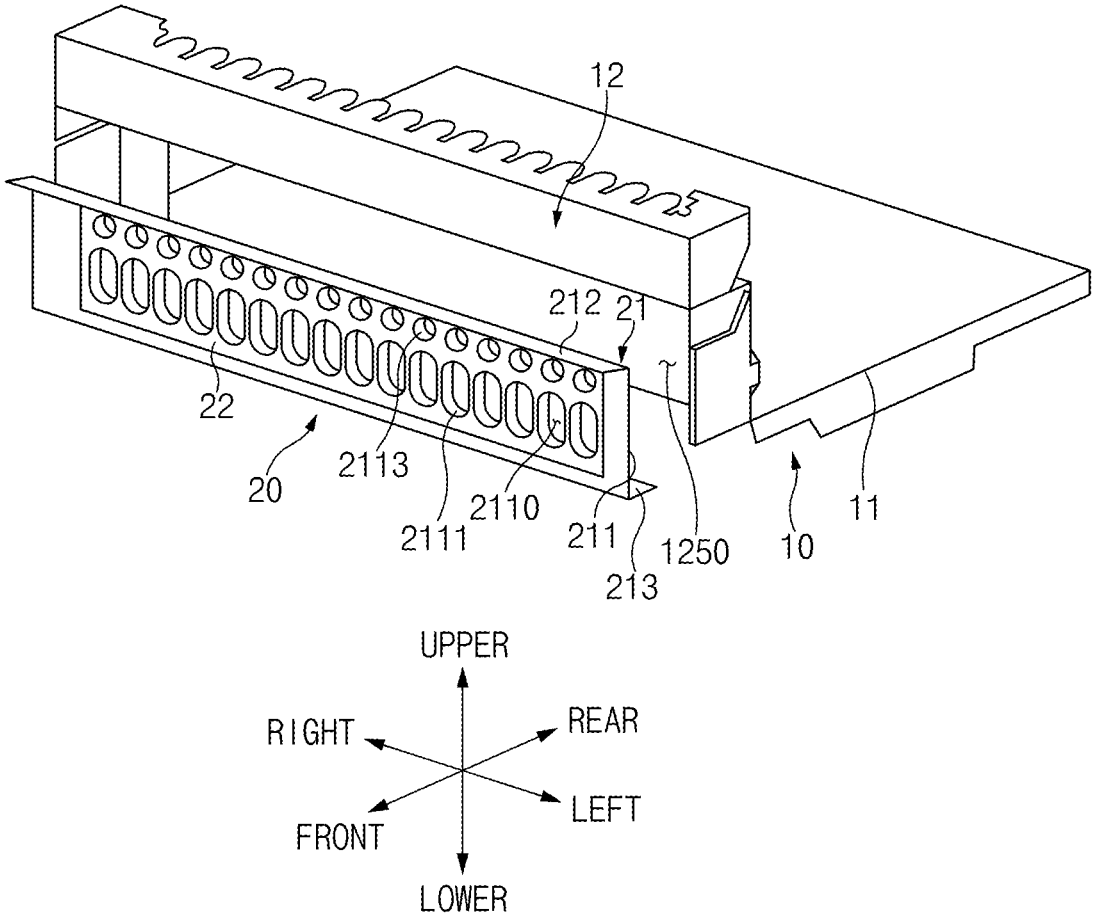
FIG. 9 is a perspective view illustrating a flow passage guide, and a front plate and a lower plate included in the case according to an embodiment of the present disclosure.
Figure 10:
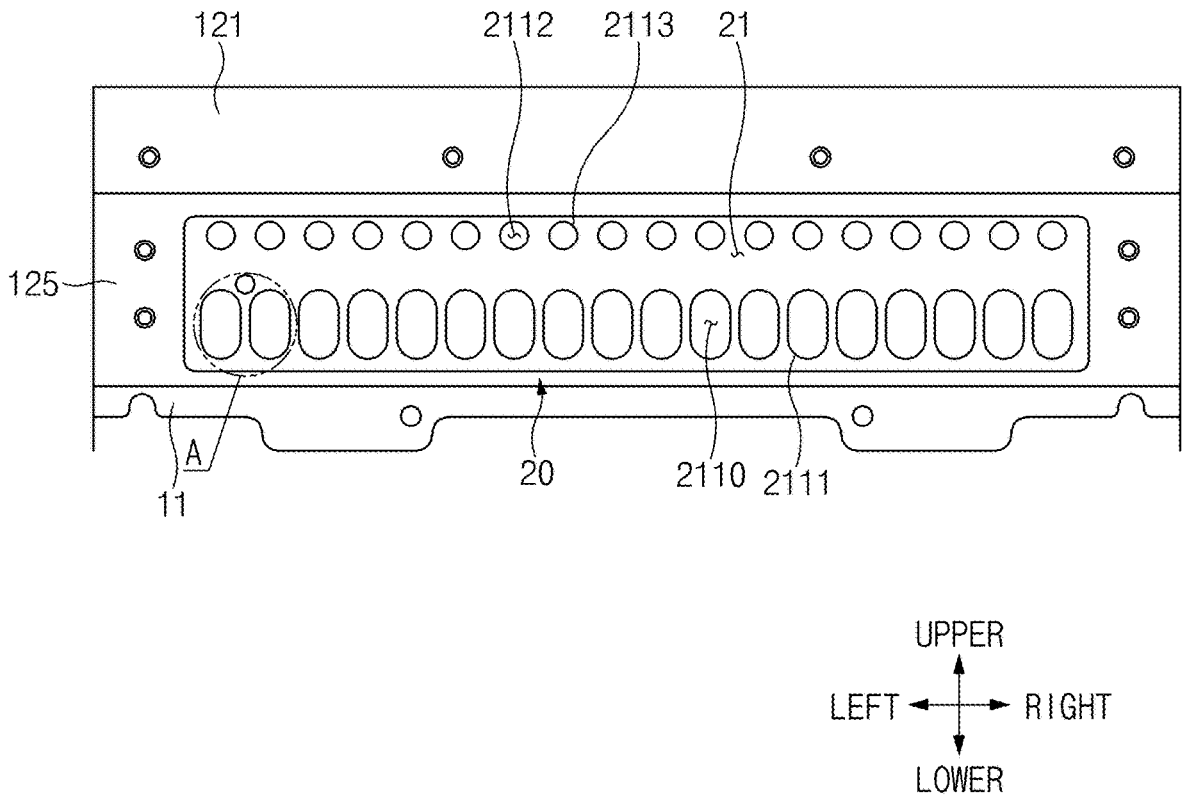
FIG. 10 is a front view illustrating a state in which the flow passage guide is coupled to the case according to an embodiment of the present disclosure.
Figure 11:
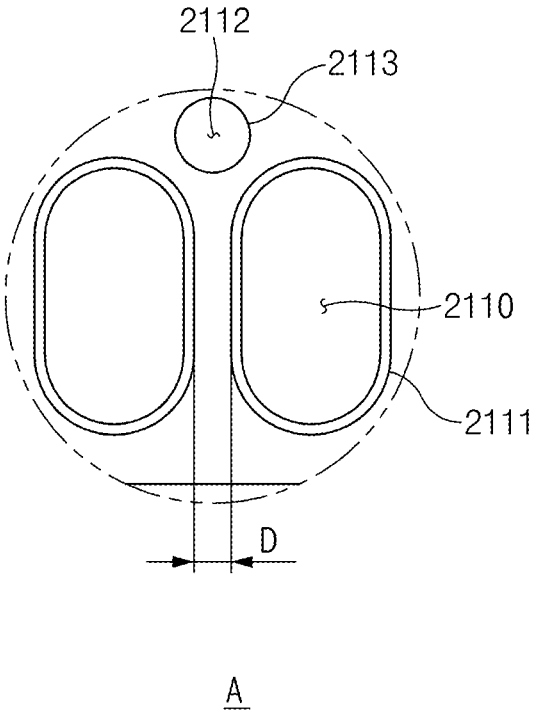
FIG. 11 is a blowup of region A in FIG. 10.

FIG. 9 is a perspective view illustrating the flow passage guide 20, and the front plate 12 and the lower plate 11 included in the case 10 according to an embodiment of the present disclosure. FIG. 10 is a front view illustrating a state in which the flow passage guide 20 is coupled to the case 10 according to an embodiment of the present disclosure. FIG. 11 is a blowup of region A in FIG. 10.

The flow passage guide 20 will be described below with additional reference to FIGS. 9 to 11. The flow passage guide 20 includes first fuel openings 2110 and guides fuel injected from a fuel nozzle to the first fuel inlets 41 of the burner units 40. As many first fuel openings 2110 as the first fuel inlets 41 of the burner units 40 coupled to the case 10 may be formed.

As the first fuel inlets 41 are disposed on the front sides of the burner units 40, the flow passage guide 20 may be coupled to the front plate 12 located at the front of the case 10. The front plate 12 may have a front plate opening 1250 that is open such that the flow passage guide 20 coupled to the front plate 12 is exposed to an interior space of the case 10.

As illustrated, the flow passage guide 20 according to an embodiment of the present disclosure is implemented as separate from the case 10. The flow passage guide 20 may be formed as an object separate from the case 10 and may be coupled to the case 10 to form the burner assembly 1 together with the burner units 40. As the flow passage guide 20 is implemented as separate from the case 10, guide plates 21 and 22 that form the flow passage guide 20 and the case plate that forms the case 10 may be formed of different materials.

The flow passage guide 20 may be constituted by the two guide plates 21 and 22, including the first guide plate 21 having the first fuel openings 2110 formed therein and the second guide plate 22 coupled to the first guide plate 21. The first guide plate 21 and the second guide plate 22 may be combined to form the flow passage guide 20. The first guide plate 21 and the second guide plate 22 may be formed of different materials or the same material.

The first guide plate 21 may have a lower stiffness than the case plate. Accordingly, forming the flow passage guide by forming the first guide plate 21 may be easier than forming the case 10 by forming the case plate. For example, when a process of punching holes in the first guide plate 21 by a press is performed, a smaller force may be applied, the first fuel openings 2110 and second fuel openings 2112 corresponding to a plurality of holes may be formed with a smaller interval therebetween, and first fuel guides 2111 and second fuel guides 2113 corresponding to burrs may have a greater height than when a process of punching holes in the case plate is performed. Furthermore, a defect rate may be lowered by using a plate having a low stiffness in a punching process. As the holes are formed with a smaller interval therebetween, the combustibility of the burner units 40 may be improved.

The first guide plate 21 and the case plate may be formed of different materials such that the first guide plate 21 and the case plate have a difference in stiffness. Alternatively, the first guide plate 21 and the case plate may be formed of the same material, but the first guide plate 21 may have a smaller thickness than the case plate. Specifically, the thickness of the case plate may be 1.5 to 2 times the thickness of the first guide plate 21. The thickness of the first guide plate 21 may range from 0.4 mm to 0.5 mm.

The periphery of each of the first fuel openings 2110 may include an upper periphery having a shape convex upward, two intermediate peripheries extending downward from opposite ends of the upper periphery, and a lower periphery having a shape convex downward and having opposite ends connected to the two intermediate peripheries.

The first guide plate 21 may include a first guide intermediate plate 211 having the first fuel openings 2110 formed therein, and a first guide upper plate 212 and a first guide lower plate 213 disposed on an upper end and a lower end of the first guide intermediate plate 211. The first guide intermediate plate 211 and the first guide lower plate 213 may be fastened to the front plate 12 and the lower plate 11 by fasteners such that the flow passage guide 20 is coupled to the case 10.

The flow passage guide 20 may include the first fuel guides 2111 protruding rearward from the peripheries of the first fuel openings 2210, and the first fuel inlets 41 of the burner units 40 may be inserted into the first fuel guides 2111. The first fuel guides 2111 may be formed in a process of punching the first fuel openings 2110 in the first guide plate 21 in the rear direction. Accordingly, the thickness of the first fuel guides 2111 may be equal to the thickness of the first guide plate 21. As the periphery of each of the first fuel openings 2110 is formed as described above, each of the first fuel guides 2111 may be divided into three portions similarly to the periphery of the first fuel opening 2110.

As many first fuel guides 2111 as the first fuel openings 2110 may be formed. Likewise to the plurality of first fuel openings 2110 arranged in a left/right direction, the plurality of first fuel guides 2111 may be arranged in the left/right direction. The distance D by which the first fuel guides 2111 adjacent to each other among the plurality of first fuel guides 2111 are spaced apart from each other may be three to four times the thickness of the burner plates. The distance D by which the adjacent first fuel guides 2111 are spaced apart from each other may be a distance by which portions of the first fuel guides 2111 that correspond to intermediate peripheries and that are formed in a straight line in an up/down direction are spaced apart from each other. The distance D by which the adjacent first fuel guides 2111 are spaced apart from each other may range from 1 mm to 1.2 mm.

The burner units 40 may be coupled with the flow passage guide 20 by inserting the first fuel inlets 41 into the first fuel guides 2111. The distance by which the adjacent burner units 40 are spaced apart from each other in the state in which the plurality of burner units 40 are coupled with the flow passage guide 20 is referred to as a separation distance. The separation distance may be a distance by which flames generated from the adjacent burner units 40 do not merge with each other. In a case where the flames generated from the adjacent burner units 40 merge with each other, carbon monoxide and nitrogen oxide may be excessively increased, which causes degradation in combustibility. Accordingly, the burner units 40 need to remain spaced apart from each other by the separation distance.

The separation distance may be 1.3 to 1.5 times the thickness of the burner plates. The separation distance may range from 0.3 mm to 0.5 mm.

As described above, the flow passage guide 20 according to an embodiment of the present disclosure is implemented with a plate separate from the case 10. Accordingly, the distance D by which the adjacent first fuel guides 2111 are spaced apart from each other and the separation distance may be smaller than those in the exemplary case, and an arrangement of the plurality of burner units 40 may be improved. Thus, the entire size of the burner assembly 1 may be reduced, and the water heating device may be supplied with thermal power that is not insufficient. However, the burner units 40 are not brought into contact with each other or are not excessively close to each other, and thus a situation in which combustibility is degraded due to excess carbon monoxide and nitrogen oxide may be prevented.

In addition to the first fuel openings 2110, the second fuel openings 2112 through which fuel is additionally introduced may be formed in the first guide intermediate plate 211 of the first guide plate 21. The second fuel openings 2112 may be formed in a circular shape. Likewise to the first fuel openings 2110, the second fuel guides 2113 may protrude rearward from the peripheries of the second fuel openings 2112, and the second fuel inlets 42 of the burner units 40 may be inserted into the second fuel guides 2113.

The second guide plate 22 may be coupled to the front of the first guide plate 21 to form the flow passage guide 20. The second guide plate 22 has first intermediate fuel openings 2211 and second intermediate fuel openings 2212. The first intermediate fuel openings 2211 are formed by cutting away portions corresponding to the first fuel openings 2110 so as not to close the first fuel openings 2110, and the second intermediate fuel openings 2212 are formed by cutting away portions corresponding to the second fuel openings 2112 so as not to close the second fuel openings 2112. However, the first intermediate fuel openings 2211 and the second intermediate fuel openings 2212 may cover portions of the first fuel openings 2110 and the second fuel openings 2112.

The second guide plate 22 may have turbulators 2213 on portions corresponding to the first fuel openings 2110. To generate vortices in the flow of fuel introduced through the first fuel openings 2110, the turbulators 2213 may be disposed in the first fuel openings 2110 to form resistance.

Figure 12:
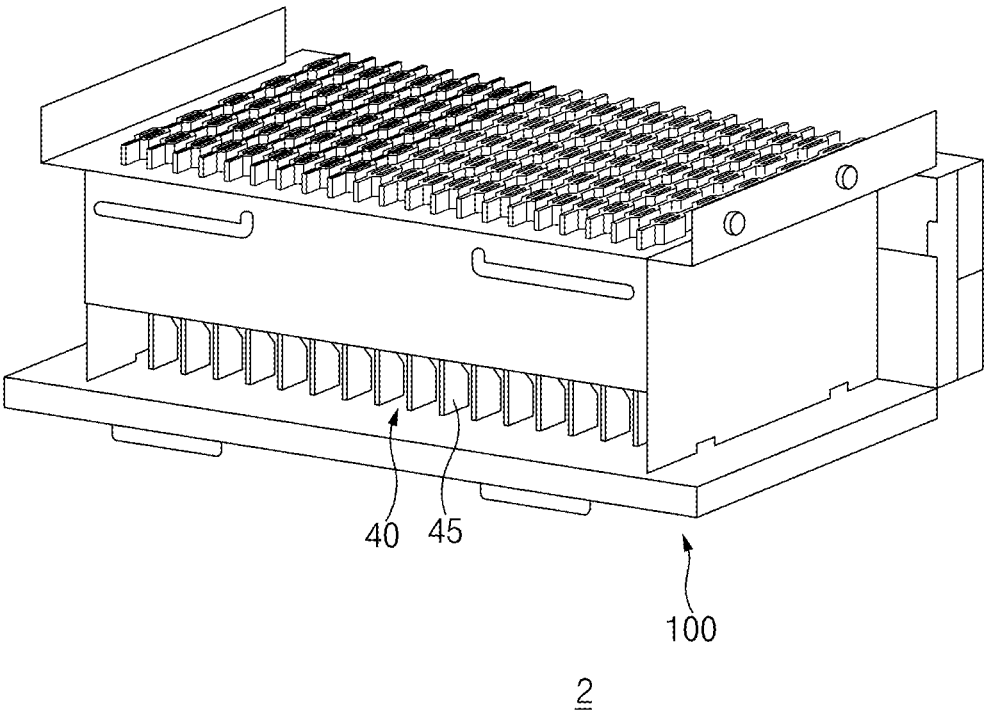
FIG. 12 is a perspective view of an exemplary burner assembly.
Figure 13:
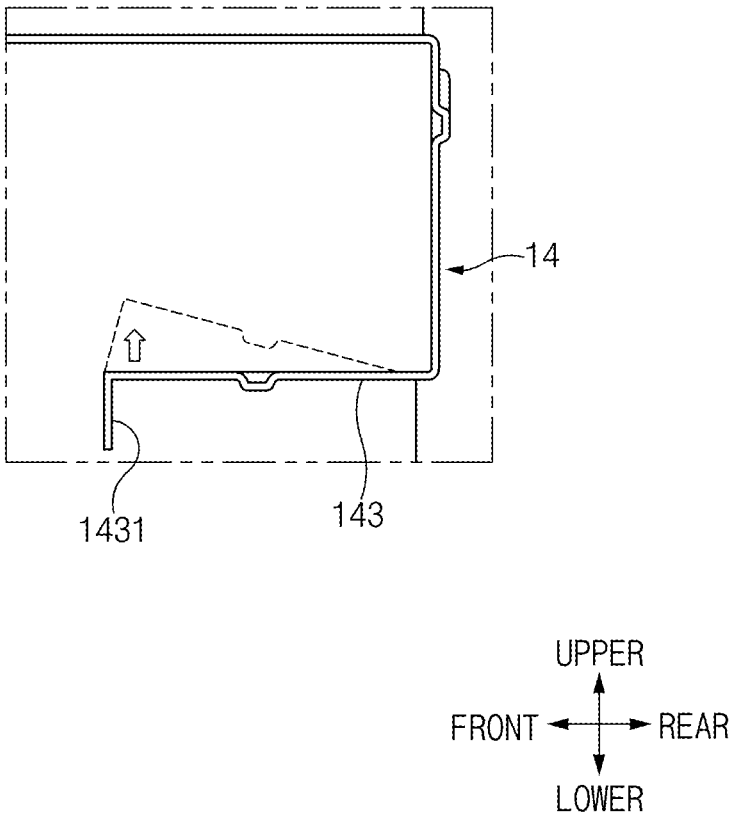
FIG. 13 is a view illustrating an arrangement state of a rear bracket in the exemplary burner assembly.

FIG. 12 is a perspective view of an exemplary burner assembly 2. FIG. 13 is a view illustrating an arrangement state of a rear bracket 143 in the exemplary burner assembly 2.

The rear bracket 143 may be disposed at the rear of the exemplary burner assembly 2. The rear bracket 143 may protrude forward from a rear plate 14. As illustrated in FIG. 6, the rear bracket 143 may include, at the front thereof, slots (1432 of FIG. 6) into which rear insert portions (44 of FIG. 4) of burner units (40 of FIG. 4) are inserted. The slots 1432 may be formed between a plurality of rear bracket protrusions 1431 further protruding forward beyond the other portion of the rear bracket 143. The rear bracket protrusions 1431 may have a shape that extends forward and is bent downward.

The protruding portions 45 and the rear insert portions 44 of the burner units 40 are inserted into the slots 1432, and the protruding portions 45 are pressed downward by the rear bracket 143. Accordingly, the positions of the burner units 40 relative to a case 100 are fixed. However, the rear bracket 143 may be formed by bending a plate such as the rear plate 14, and a structure for holding the rear bracket 143 down does not exist in the exemplary burner assembly 2. Therefore, as illustrated by the dotted line in FIG. 13, the rear bracket 143 may be bent upward. As the rear bracket 143 is bent upward, the rear bracket 143 may not appropriately press the protruding portions 45 of the burner units 40 downward.

Auxiliary Bracket 30

Figure 14:
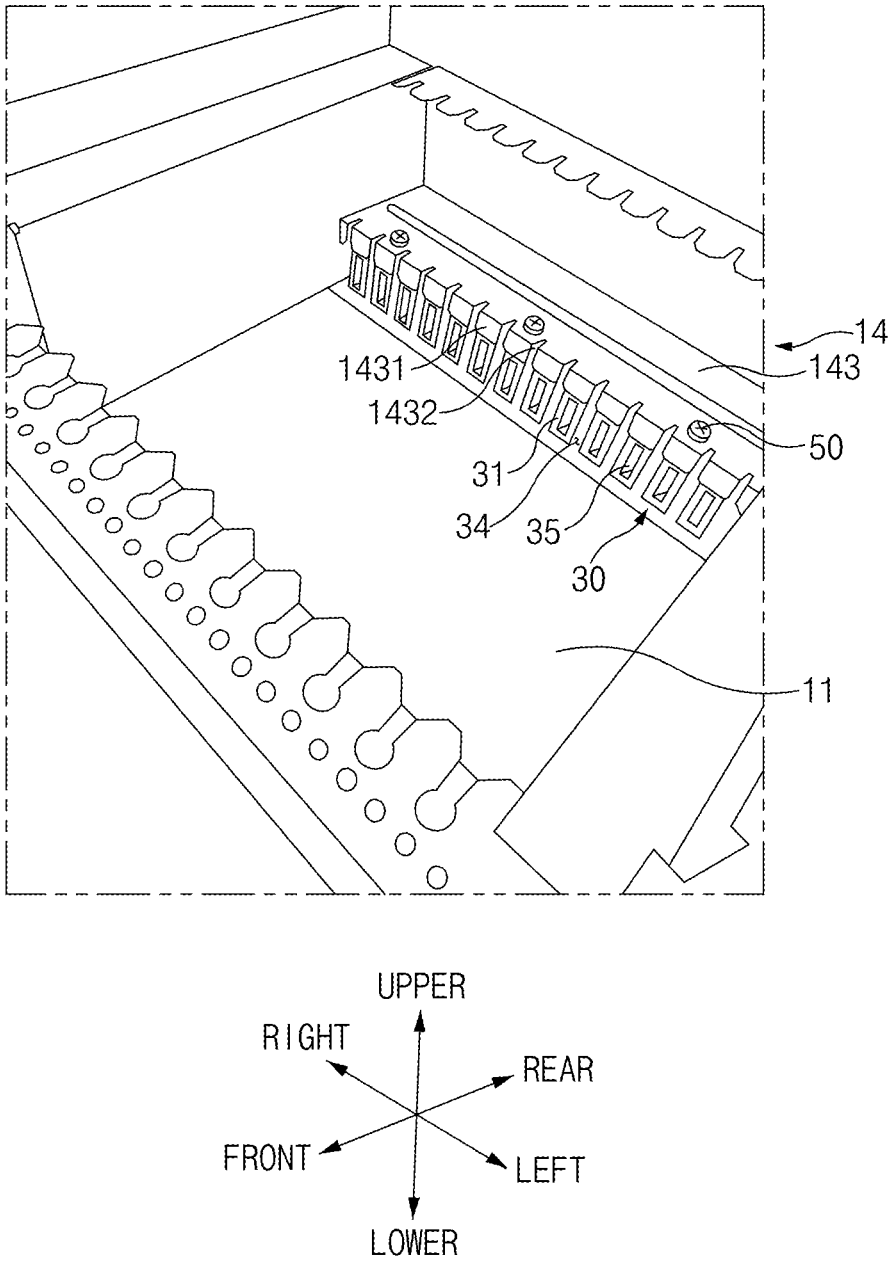
FIG. 14 is a perspective view illustrating the interior of the case according to an embodiment of the present disclosure.
Figure 15:
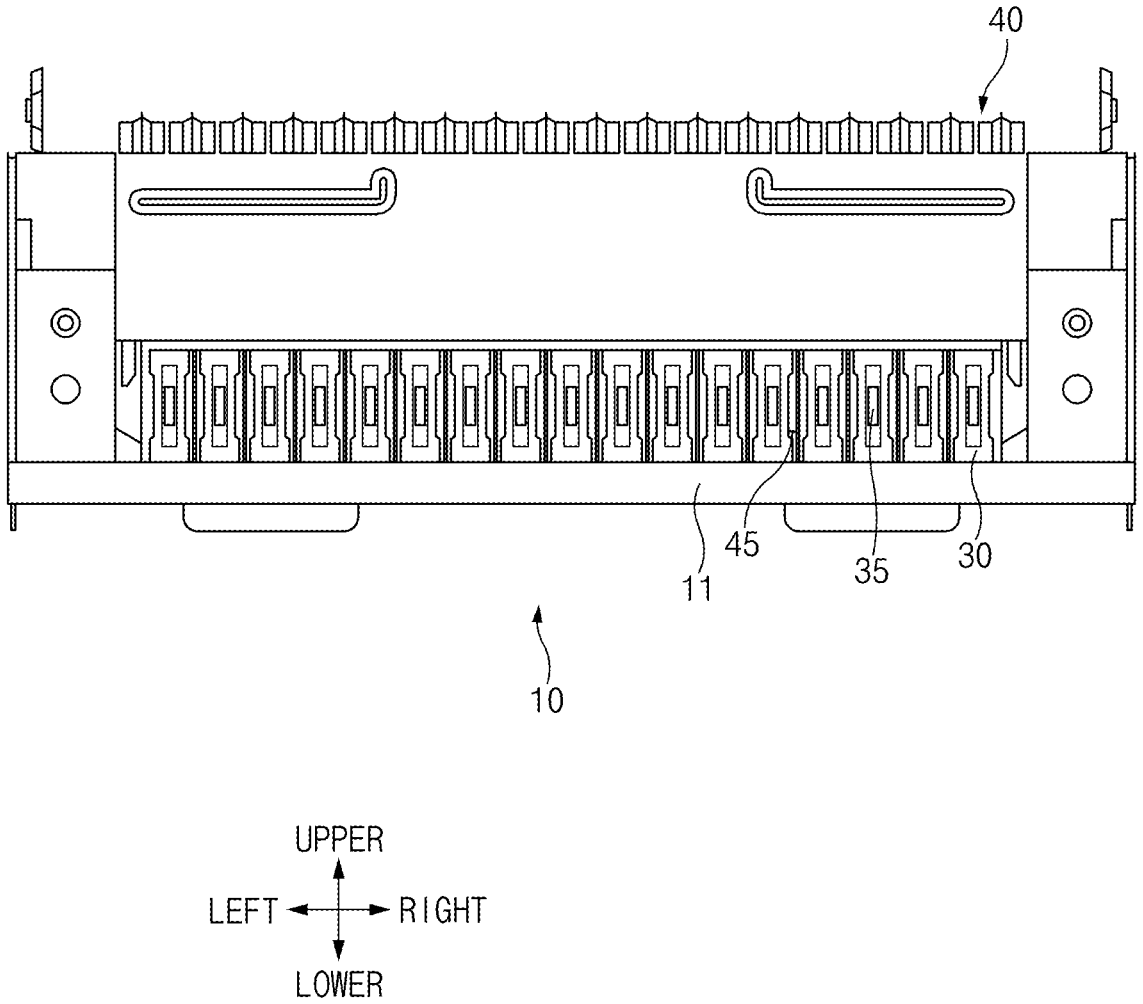
FIG. 15 is a rear view of the burner assembly according to an embodiment of the present disclosure.
Figure 16:
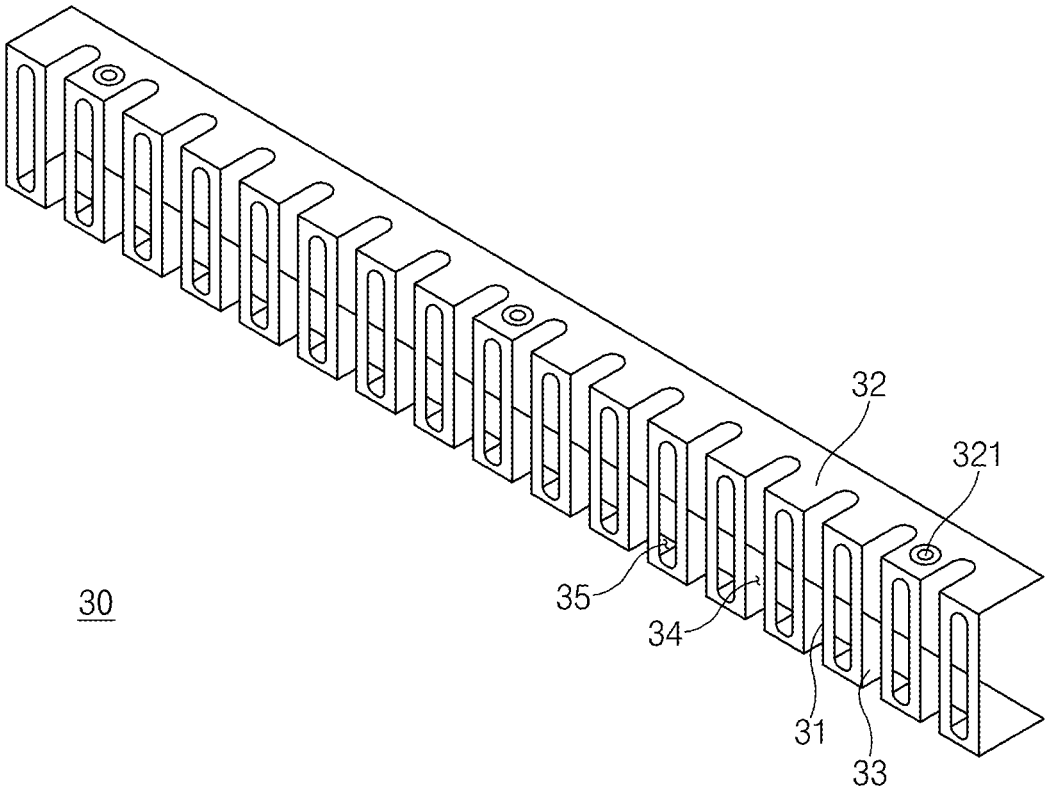
FIG. 16 is a perspective view of an auxiliary bracket according to an embodiment of the present disclosure.
Figure 16:
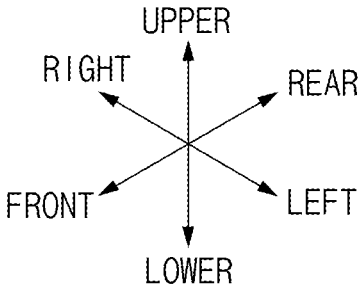
Figure 17:
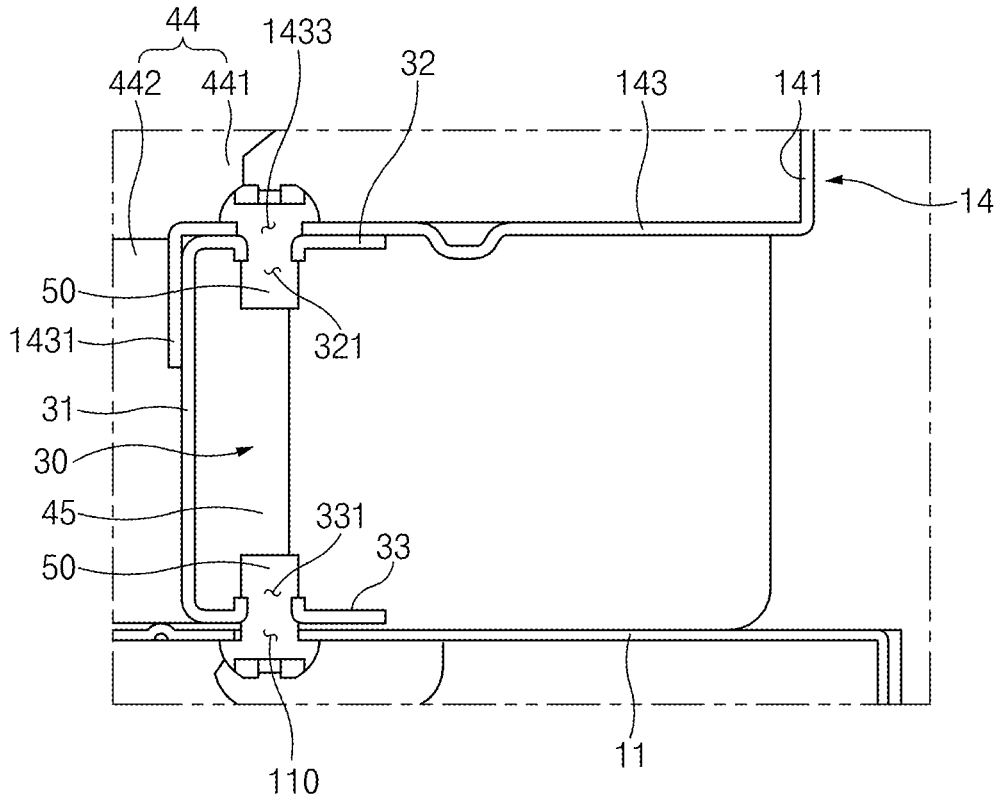
FIG. 17 is an enlarged vertical sectional view illustrating an area where the auxiliary bracket of the burner assembly is installed according to an embodiment of the present disclosure.
Figure 17:
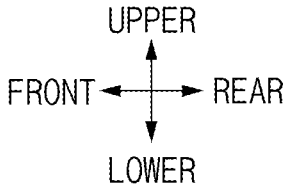

FIG. 14 is a perspective view illustrating the interior of the case 10 according to an embodiment of the present disclosure. FIG. 15 is a rear view of the burner assembly 1 according to an embodiment of the present disclosure. FIG. 16 is a perspective view of the auxiliary bracket 30 according to an embodiment of the present disclosure. FIG. 17 is an enlarged vertical sectional view illustrating an area where the auxiliary bracket 30 of the burner assembly 1 is installed according to an embodiment of the present disclosure.

The auxiliary bracket 30 according to an embodiment of the present disclosure will be described below with additional reference to FIGS. 14 to 17. Although the auxiliary bracket 30 is not illustrated in FIG. 4, the auxiliary bracket 30, as illustrated in FIG. 17, may be disposed in the area where the rear insert portions 44 and the protruding portions 45 of the burner units 40 are formed in the burner assembly 1 according to an embodiment of the present disclosure.

The auxiliary bracket 30 is a part that connects the lower plate 11 and the rear bracket 143. The auxiliary bracket 30 may be coupled to the lower plate 11 and the rear bracket 143 to maintain a predetermined separation distance between the lower plate 11 and the rear bracket 143 in the up/down direction. The auxiliary bracket 30 may fix the position of the rear bracket 143 relative to the lower plate 11, thereby preventing the rear bracket 143 from being bent upward as illustrated in FIG. 13. Accordingly, the protruding portions 45 of the burner units 40 may be fixed well in the up/down direction by being sandwiched between the rear bracket 143 and the lower plate 11, and the insert portions inserted into the slots 1432 may be fixed in the left/right direction. As the positions of the burner units 40 are firmly fixed, shaking of the burner units 40 and instability of a combustion reaction may be reduced.

The auxiliary bracket 30 may include a rear bracket coupling portion 32 coupled to the rear bracket 143, a lower plate coupling portion 33 coupled to the lower plate 11, and an auxiliary connecting portion 31 connecting the rear bracket coupling portion 32 and the lower plate coupling portion 33.

The rear bracket coupling portion 32 may have a surface parallel to the rear bracket 143 and may have rear fastening holes 321 through which fasteners 50, such as screws or bolts, pass to couple the rear bracket coupling portion 32 to the rear bracket 143. The fasteners 50 may pass through rear bracket fastening holes 1433 formed in the rear bracket 143.

The lower plate coupling portion 33 may have a surface parallel to the lower plate 11 and may have lower plate fastening holes 331 through which the fasteners 50 pass to couple the lower plate coupling portion 33 to the lower plate 11. The fasteners 50 may pass through lower plate fastening holes 110 formed in the lower plate 11.

The auxiliary connecting portion 31 may have a shape extending in the up/down direction. The auxiliary connecting portion 31 may be divided into a plurality of portions, and auxiliary slots 34 may be provided between the portions. The auxiliary slots 34 may extend in the up/down direction and may be open forward and rearward. The auxiliary slots 34 may be aligned with the slots 1432 of the rear bracket 143 such that the rear insert portions 44 and the protruding portions 45 of the burner units 40 pass through the auxiliary slots 34 and the slots 1432. A plurality of additional openings 35 may be formed in the auxiliary connecting portion 31.

The rear bracket coupling portion 32 and the lower plate coupling portion 33 may extend rearward from an upper end and a lower end of the auxiliary connecting portion 31 by a predetermined length and may firmly support the rear bracket 143 and the lower plate 11.

As described above, the present disclosure provides the burner assembly having the burner units disposed at minimized intervals. Accordingly, the present disclosure may provide appropriate thermal power to heat water without affecting combustibility, thereby enabling a stable combustion reaction.

Hereinabove, even though all of the components are coupled into one body or operate in a combined state in the description of the above-mentioned embodiments of the present disclosure, the present disclosure is not limited to these embodiments. That is, all of the components may operate in one or more selective combination within the range of the purpose of the present disclosure. It should be also understood that the terms of "include", "comprise" or "have" in the specification are "open type" expressions just to say that the corresponding components exist and, unless specifically described to the contrary, do not exclude but may include additional components. Unless otherwise defined, all terms used herein, including technical and scientific terms, have the same meaning as those generally understood by those skilled in the art to which the present disclosure pertains. Such terms as those defined in a generally used dictionary are to be interpreted as having meanings equal to the contextual meanings in the relevant field of art, and are not to be interpreted as having ideal or excessively formal meanings unless clearly defined as having such in the present application.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims. Therefore, the exemplary embodiments of the present disclosure are provided to explain the spirit and scope of the present disclosure, but not to limit them, so that the spirit and scope of the present disclosure is not limited by the embodiments. The scope of the present disclosure should be construed on the basis of the accompanying claims, and all the technical ideas within the scope equivalent to the claims should be included in the scope of the present disclosure.

What is claimed is:

1. A burner assembly comprising:

a plurality of burner units including, on front sides thereof, fuel inlets through which fuel is introduced into the plurality of burner units, the plurality of burner units being configured to cause a combustion reaction using the introduced fuel;

a case to which the plurality of burner units are coupled with a predetermined separation distance therebetween; and a flow passage guide coupled to a front side of the case, the flow passage guide including a plurality of fuel openings corresponding to the fuel inlets of the plurality of burner units, wherein the flow passage guide is implemented as separate from the case, wherein the case includes a lower plate having the burner units seated thereon and a rear bracket spaced apart upward from the lower plate behind the burner units and including a plurality of slots, wherein the burner units further include rear insert portions formed on rear sides of the burner units so as to be fixedly inserted into the slots and protruding portions protruding rearward from the rear insert portions so as to be sandwiched between the rear bracket and the lower plate, and wherein the burner assembly further comprises an auxiliary bracket coupled to the lower plate and the rear bracket to maintain a predetermined separation distance between the lower plate and the rear bracket in an up/down direction.

2. The burner assembly of claim 1, wherein each of the burner units is formed by pressing a plurality of burner plates, and wherein the separation distance is 1.3 to 1.5 times a thickness of the burner plates.

3. The burner assembly of claim 1, wherein the separation distance ranges from 0.3 mm to 0.5 mm.

4. The burner assembly of claim 1, wherein the case is formed by using a case plate, and wherein a plate including the fuel openings of the flow passage guide has a lower stiffness than the case plate.

5. The burner assembly of claim 4, wherein a thickness of the case plate is 1.5 to 2 times a thickness of the plate including the fuel openings of the flow passage guide.

6. The burner assembly of claim 5, wherein the thickness of the plate including the fuel openings of the flow passage guide ranges from 0.4 mm to 0.5 mm.

7. The burner assembly of claim 4, wherein the flow passage guide is formed by a coupling of a first guide plate and a second guide plate having the fuel openings formed therein, and wherein the second guide plate includes turbulators disposed in the fuel openings to form resistance so as to form vortices in a flow of the fuel introduced through the fuel openings.

8. The burner assembly of claim 1, wherein the separation distance is a distance by which flames generated from the burner units adjacent to each other among the plurality of burner units do not merge with each other.

9. The burner assembly of claim 1, wherein a periphery of each of the fuel openings includes an upper periphery having a shape convex upward, two intermediate peripheries extending downward from opposite ends of the upper periphery, and a lower periphery having a shape convex downward and having opposite ends connected to the two intermediate peripheries.

10. The burner assembly of claim 1, wherein the auxiliary bracket includes:

a rear bracket coupling portion having a surface parallel to the rear bracket, the rear bracket coupling portion being coupled to the rear bracket;

a lower plate coupling portion having a surface parallel to the lower plate, the lower plate coupling portion being coupled to the lower plate; and an auxiliary connecting portion configured to connect the rear bracket coupling portion and the lower plate coupling portion.

11. The burner assembly of claim 1, wherein the auxiliary bracket includes a plurality of auxiliary slots aligned with the slots such that the rear insert portions pass through the slots and the auxiliary slots.

12. The burner assembly of claim 11, wherein the auxiliary bracket further includes a plurality of cut-out openings located between the plurality of auxiliary slots.

13. The burner assembly of claim 1, wherein the case further includes a rear plate located behind the burner units, and wherein the rear bracket protrudes forward from the rear plate.

14. A burner assembly comprising:

a plurality of burner units including, on front sides thereof, fuel inlets through which fuel is introduced into the plurality of burner units, the plurality of burner units being configured to cause a combustion reaction using the introduced fuel;

a case to which the plurality of burner units are coupled with a predetermined separation distance therebetween; and a flow passage guide coupled to a front side of the case, the flow passage guide including a plurality of fuel openings corresponding to the fuel inlets of the plurality of burner units, wherein the flow passage guide is implemented as separate from the case, wherein each of the burner units is formed by using a plurality of burner plates, wherein the flow passage guide further includes a plurality of fuel guides protruding rearward from peripheries of the fuel openings so as to be inserted into the fuel inlets, and wherein a distance by which the plurality of fuel guides are spaced apart from each other is three to four times a thickness of the burner plates.

* * * * *